US005090069A

United States Patent [19]

Decaux

[11] Patent Number: 5,090,069

[45] Date of Patent: Feb. 25, 1992

[54] SELF-CLEANING SANITATION MODULE INCORPORATING A TILTING BACK

[76] Inventor: Jean-Claude Decaux, 88, boulevard Maurice Barres, 92200 Neuilly, France

[21] Appl. No.: 389,837

[22] Filed: Aug. 4, 1989

[30] Foreign Application Priority Data

Aug. 8, 1988 [FR] France ..... 88 10686

[51] Int. Cl.[5] ..... A47K 4/00; E03C 1/01

[52] U.S. Cl. ..... 4/662; 4/312; 4/420; 4/460; 4/DIG. 2

[58] Field of Search ..... 52/34; 4/300, 662, DIG. 6, 4/DIG. 2, 460, 307, 312, 420

[56] References Cited

U.S. PATENT DOCUMENTS 2,552,546 5/1951 Fergusson ..... 52/34
4,174,546 11/1979 Ohtake ..... 4/DIG. 6
4,210,973 7/1980 Decaux ..... 4/300 X
4,301,558 11/1981 Decaux ..... 4/662 X
4,642,821 2/1987 Zanuso et al. ..... 4/662
4,797,959 1/1989 Decaux ..... 4/662

FOREIGN PATENT DOCUMENTS 0059134 2/1982 European Pat. Off. .
0109469 11/1982 European Pat. Off. .
0242274 4/1987 European Pat. Off. .

*Primary Examiner*—Henry K. Artis
*Attorney, Agent, or Firm*—Andrus, Sceales, Starke & Sawall

[57] ABSTRACT

A self-cleaning sanitation module comprises a toilet pan movable between a use position and a cleaning position in which it is behind a separating wall. A back is provided movable between two positions, a use position and a cleaning position in which the back in disposed vertically above the pan. The displacement of the pan and the back between their use position and their cleaning position is performed in such a way that there is always a very small gap between the back and the pan.

9 Claims, 9 Drawing Sheets

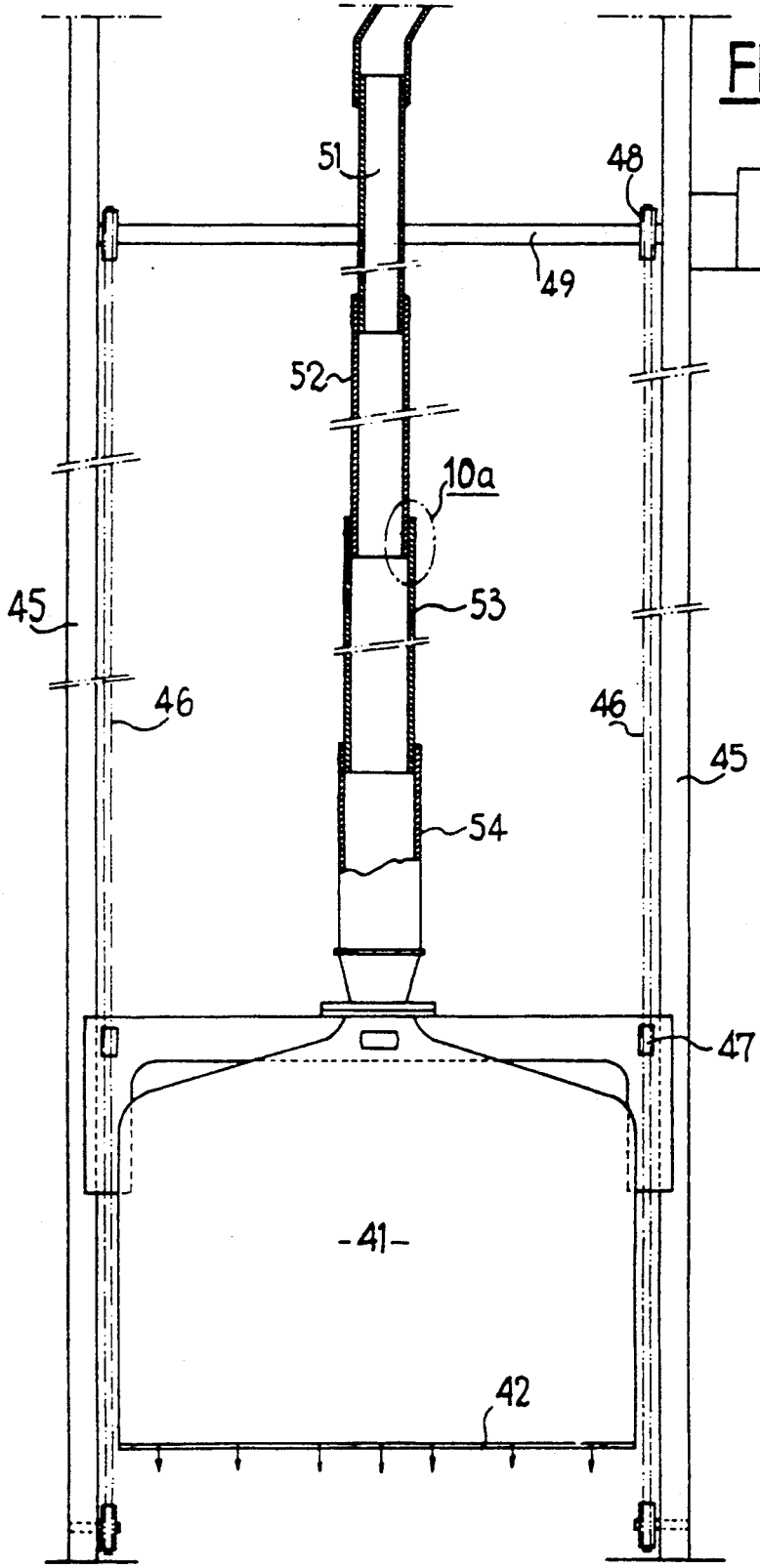
FIG. 8
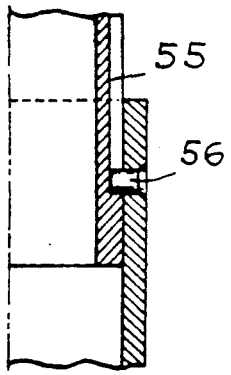
FIG. 10a
FIG. 9
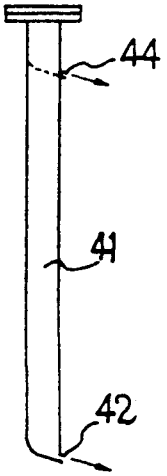

SELF-CLEANING SANITATION MODULE INCORPORATING A TILTING BACK

BACKGROUND OF THE INVENTION

1. Field of the Invention

The present invention concerns self-cleaning sanitation modules, that is to say sanitation modules that can be installed in public or semi-public places and cleaning of which is automatically commanded when the user has left the enclosure of the module.

2. Description of the Prior Art

There are specifically known sanitation modules the use of which is charged for and which constitute an autonomous constructive unit that can be installed at any unprotected location such as a pavement or a public place. These known type sanitation modules comprise a closed enclosure which incorporate a partition defining two areas, a user area which users enter and access to which is generally commanded by a coin-operated door and a technical area prohibited to users.

A toilet pan is disposed along the separating partition and is mounted to rotate about an axis parallel to said partition so as to pivot between a use position in which the pan is substantially horizontal along said partition and a cleaning position in which said pan is disposed vertically in an opening in said partition so as to be oriented towards the technical area which comprises cleaning members.

The opening whereby the pan moves to its cleaning position is closed by a flap that is movable, vertically in translation, for example; this flap is not cleaned during the cleaning operation and this constitutes a disadvantage since users are very demanding in terms of hygiene conditions and they will often disdain from using these sanitation modules if they seem to them to be in an imperfect state of cleanliness.

Moreover, when the mobile flap is raised at the start of the cleaning operation it leaves a large opening enabling access to the technical area until the pan reaches the definitive cleaning position. This constitutes a disadvantage with regard to security as it is always possible for a user, in particular a child, to succeed in remaining in the user area when the cleaning operation has been initiated by closing the access door after using the module.

In the known sanitation module drying of the pan after washing it is achieved by aspiration which is not entirely satisfactory; in particular, droplets of water may remain on the toilet seat and users do not like this.

In current sanitation modules the technical area occupies a large volume so that the overall volume of the module is large. The technical area comprises the cleaning and drying members together with the various mechanisms which move the pan and possibly the cleaning devices. To reduce the overall volume of the module it is necessary to reduce the volume of the technical area and consequently to minimize the overall dimensions of its drying devices and its displacement mechanisms.

In known sanitation modules the pan pivots about a central substantially horizontal axis so that its lower part remains in the user area during the cleaning operation and so cannot be cleaned. Given users' demands in terms of hygiene, it is desirable to be able to clean this lower part of the pan also.

An object of the invention is a sanitation module of the type described hereinabove which does not have the aforementioned disadvantages.

SUMMARY OF THE INVENTION

A sanitation module in accordance with the invention comprises a back mobile between two positions, namely a user position in which said back is disposed in an opening in the wall and a cleaning position in which said back is disposed vertically above the toilet pan in the plane of the top opening of the latter, when it is in the cleaning position, said back having undergone rotation about a horizontal axis on moving from the use position to the cleaning position.

By virtue of this arrangement the pan and the mobile back can be cleaned and dried simultaneously. The mobile back also makes it possible to cover the opening enabling the pan to move to the cleaning position.

According to another characteristic of the invention the back is articulated in such a way as to perform, from the use position, a first rotation about a horizontal axis situated to the rear of said back in the use position in a horizontal substantially median plane of said back when it is in the use position at a distance from the latter substantially equal to half the height of said back so that the lower edge of said back remains near the front end of the pan during the rotation of the latter from the use position to the cleaning position so as to arrive at an intermediate position in which said back is substantially horizontal, and a second rotation about a horizontal axis near its lower edge in the intermediate position to reach the cleaning position.

This arrangement prevents an arm or an object being inserted into the technical area; security devices to stop the displacement mechanisms in response to an abnormal load can be provided to guard against the situation where nevertheless something is inserted into the gap between the mobile back and the upper edge of the pan during the movement towards the cleaning position.

Other characteristics and advantages of the invention will emerge from the following description and the appended drawings.

BRIEF DESCRIPTION OF THE DRAWINGS

FIGS. 8 through 10*a* show the drying device.

DESCRIPTION OF THE PREFERRED EMBODIMENT

Figure 1:
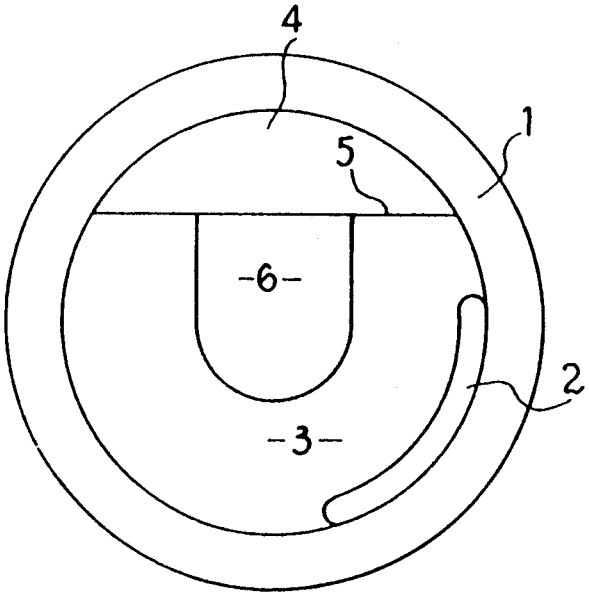
FIG. 1 is a plan view in cross-section of a sanitation module in accordance with the invention.

FIG. 1 shows in cross-section from above a sanitation module in accordance with the invention; it is housed in a circular cross-section enclosure 1 the outside diameter of which is 1.5 meters, for example. Because of its compact overall dimensions the sanitation unit shown in FIG. 1 can be integrated into a small edifice such as a "Morris column", for example. The height of the sanitation unit is 2 m which enables the sanitation module to pass through a standard size door so that it can be housed in a public or semi-public edifice such as a train station. The sanitation module in accordance with the invention can evidently be installed outdoors, for example on a sidewalk.

The enclosure 1 comprises a sliding door 2 which gives access to a user area 3 which is separated from a technical area 4 by a wall 5. The toilet pan is schematically represented at 6 and it will be noted that there is more than sufficient space for the user, in particular because of the sliding door 2.

Figure 2:
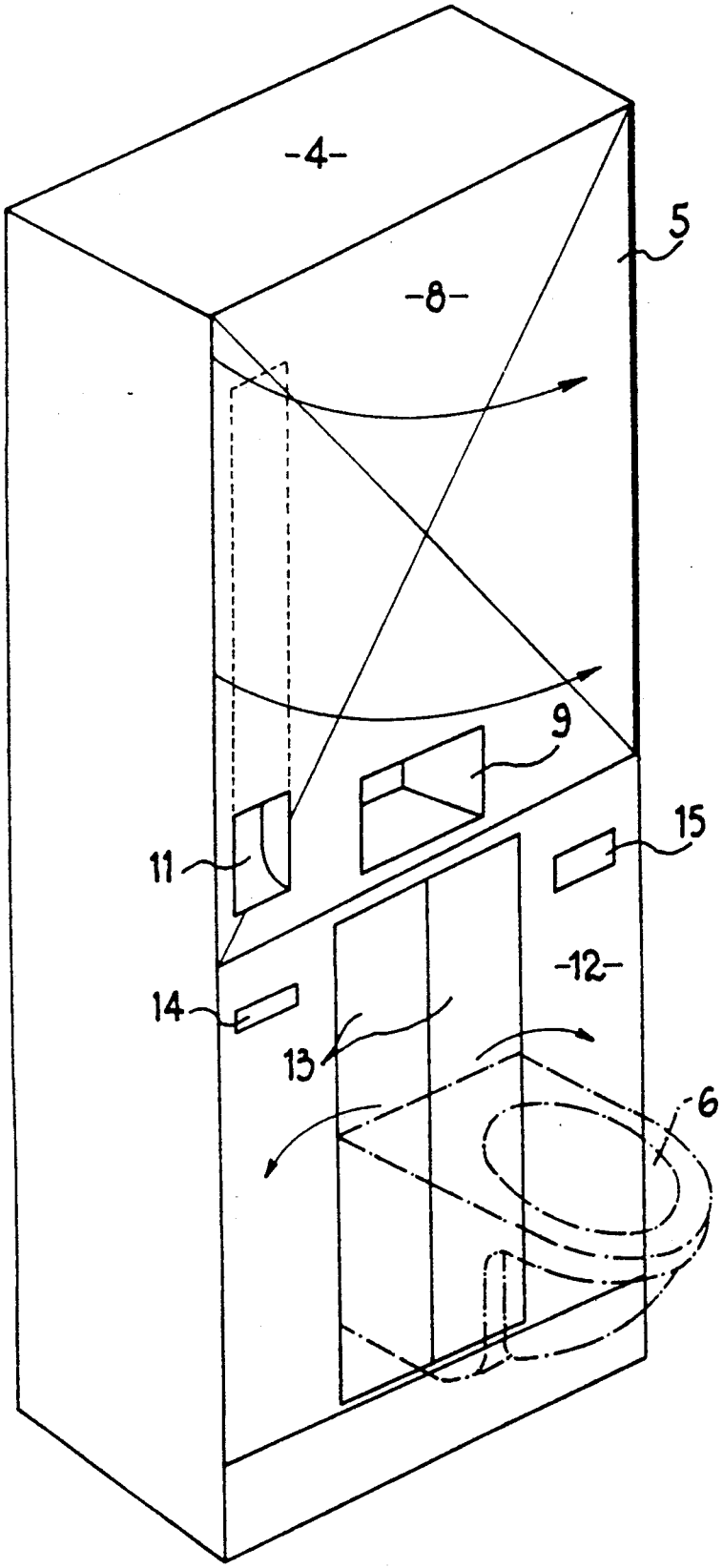
FIG. 2 is a perspective view of the functional part of the sanitation module from FIG. 1.

FIG. 2 is a schematic representation of the functional part of the module in accordance with the invention; this figure shows the wall 5, the technical area 4 and the pan 6. The upper part of the wall 5 comprises a flap 8 opening towards the interior of the user area and which carries various accessories such as an automatic handwasher 9.

The lower part 12 of the wall 5 comprises a central opening. This opening admits the pan 6 and a mobile back (not shown in FIG. 2) disposed above the pan and mounted to be movable from its use position in which it is over the pan 6 to a washing position in which it is in the compartment 4. The lower panel 12 of the wall 5 also comprises on respective sides of the pan a paper dispenser 14 and a bin 15.

Figure 3:
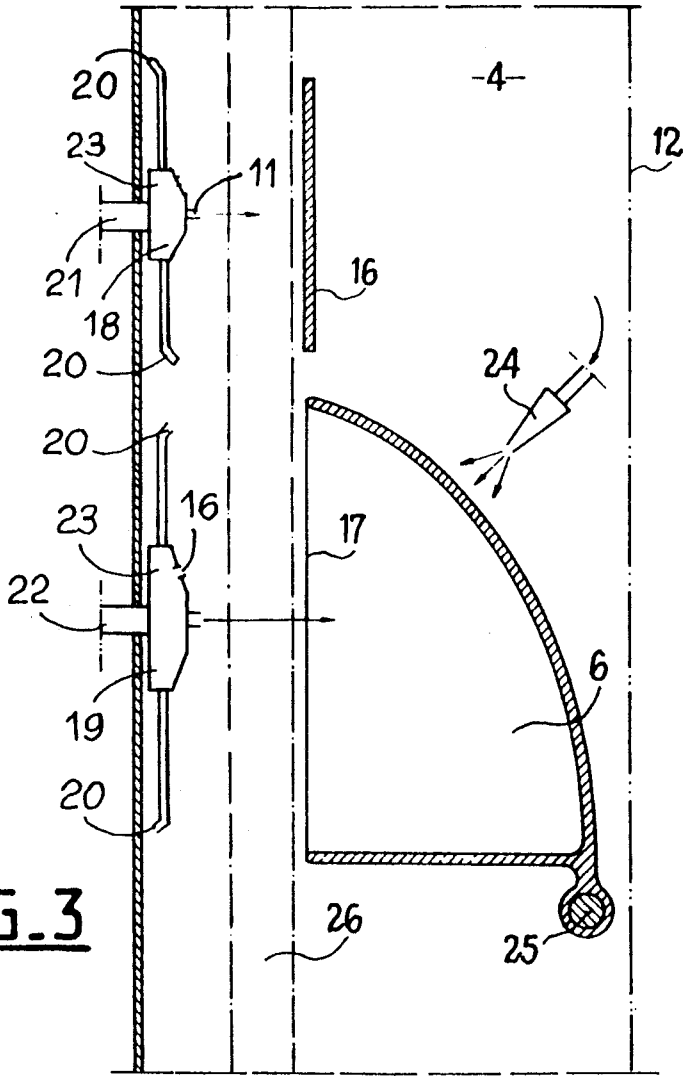
FIG. 3 is a diagram illustrating the cleaning operation.

FIG. 3 is a schematic representation of the active members of the sanitation module in accordance with the invention, that is to say the pan 6 and the mobile back 16 in the cleaning position; they are in the cleaning area 4 behind the lower panel 12 of the wall 5. It can be seen that the top opening 17 of the pan 6 and the back 16 are in the same vertical plane; two cleaning devices 18 and 19 are fixed to the rear wall of the sanitation module and each comprises a set of spray nozzles which are oriented to spray the total surface of the back 16 or of the bottom of the pan 6 and each of which comprises two diametrally opposed arms with a propulsion nozzle 20 at the end of each arm, the arms rotating about respective central axes 21, 22. Each cleaning device comprises one or more spray nozzles on its hub 23, namely a central nozzle 11 and lateral nozzle 13 in the example shown.

Two auxiliary nozzles 24 disposed to either side of the pan in the cleaning area 4 clean the lower part of the pan. During the cleaning operation the two devices 18 and 19 and the nozzle 24 spray the operative part of the back 16 and both sides of the pan 6. These cleaning systems are supplied with water under pressure. During the cleaning operation the two devices 18 and 19 are rotated about the fixed axes 21 and 22 in a similar way to the cleaning devices used in dishwashers, for example. They are rotated by the pressure of the water fed to the propulsion nozzles 20.

FIG. 3 also shows that the pan 6 is mounted to rotate about a horizontal axis 25 inside the cleaning area 4. The mobile back 16 performs a double rotation movement to be described later which makes it possible to offer up to the cleaning device 18 the operative side of the back and to prevent the insertion of objects into the technical area 4 during movement from the use position to the cleaning position. There remains between the cleaning devices 18 and 19 and the functional elements of the module, namely the pan 6 and the back 16 in the cleaning position, a vertical space 26 for a drying device to be described later.

Figure 4:
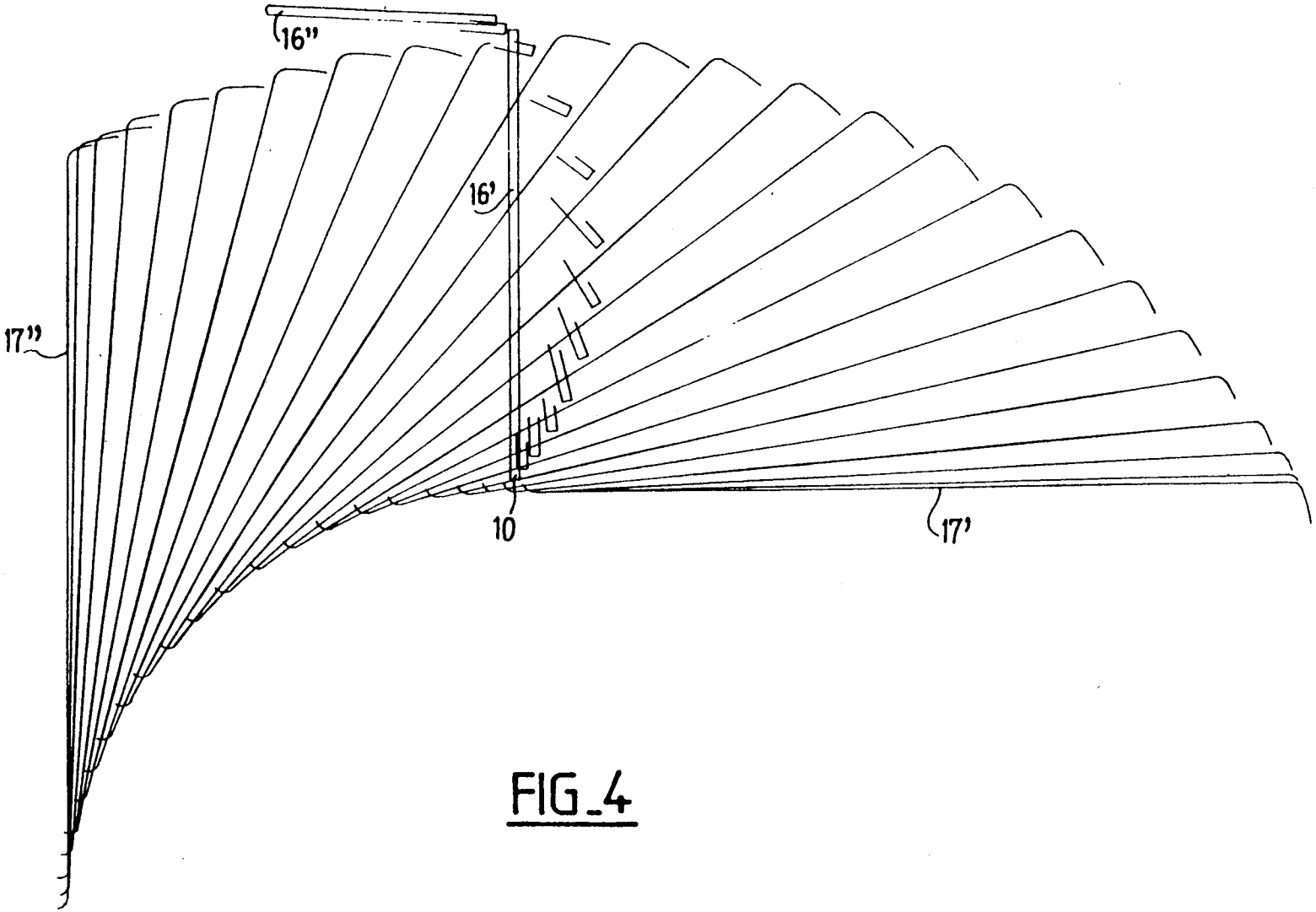
FIG. 4 is an explanatory diagram showing the respective positions of the pan and the mobile back during movement from the use position to the cleaning position.

FIG. 4 is a diagram explaining the respective movements of the top opening 17 of the pan 6 and the back 16 during the movement from the use position to the cleaning position. As mentioned above, the top surface 17 of the pan rotates about the fixed axis 25; its successive positions from the use position 17' through the cleaning position 17'' are shown in a simplified way in FIG. 4. There is also shown the back 16 in the use position 16' and in an intermediate position 16'', the various positions between the two positions 16' and 16'' being schematically represented in corresponding relationship to the positions of the upper edge 17 of the pan by the lower edge 10 of the back.

It can be seen that the various successive positions of the opening 17 and of the lower edge 10 of the back 16 are such that there is a very small distance between these two members in each position, for example a distance of 5 mm; throughout the first phase of rotation of the pan and the back 16 towards the cleaning position there is therefore no possibility of inserting any object into the cleaning area because of the small gap between the back and the pan. This feature is complemented by a security device (not shown), for example an electrical device which stops the motor driving this movement in response to any abnormal load so as to avoid any injury to a user who might have remained in the module after using it; this is on the assumption that the user has deliberately remained in the module after opening and closing the access door, the closing of the door automatically commanding the cleaning process.

As can be seen in FIG. 4, during this first phase the back 16 moves from its use position 16' to an intermediate position 16'' in which it is substantially horizontal having rotated about a horizontal axis in the median horizontal plane of the back in the use position 16' and at a distance therefrom substantially equal to half the height of the back 16.

Figure 5:
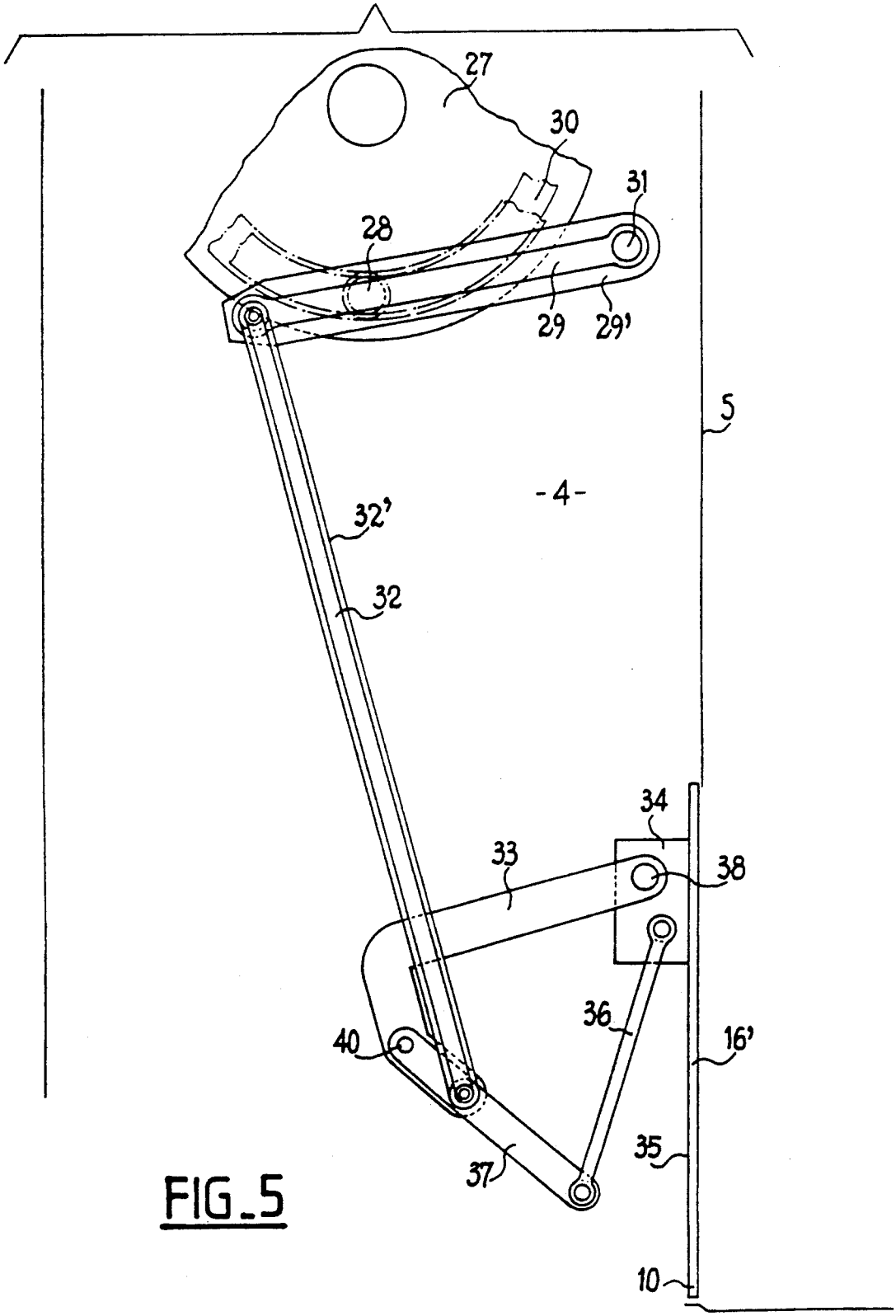
FIGS. 5 through 7 show the device for moving the mobile back from its use position to its cleaning position.
Figure 6:
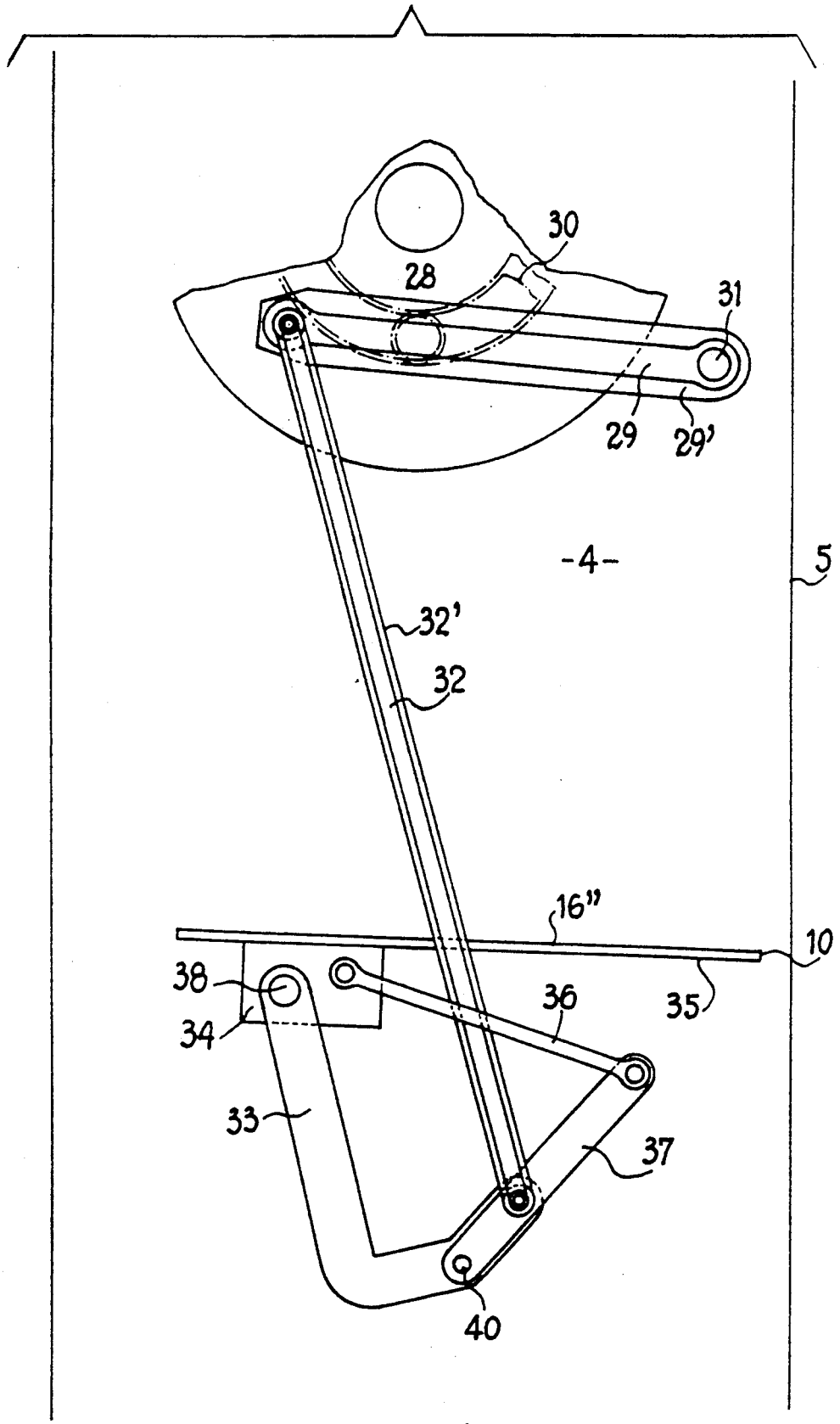
Figure 7:
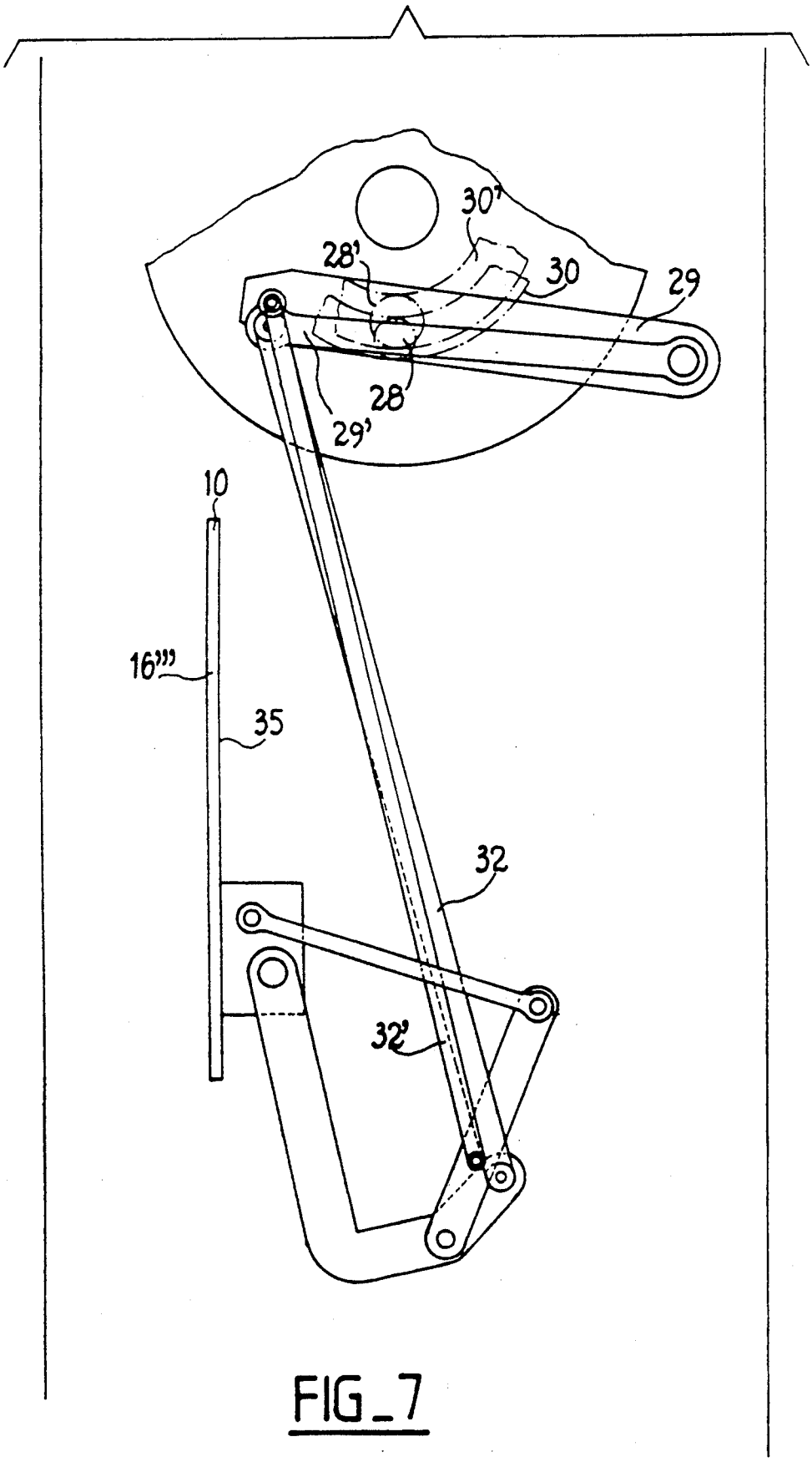

FIGS. 5 through 7 show in detail the device actuating the back 16. In accordance with the invention all movements of the mobile parts of the module in accordance with the invention are driven by a single motor-gearbox unit; the movement from the use position to the cleaning position and the return movement from the cleaning position to the use position are each driven by a half-turn of this electric motor-gearbox unit which commands each movement by means of a positive cam, by which is meant a grooved cam on which rolls a roller coupled to the member concerned.

In more precise terms, each drive mechanism comprises a lever pivotted at a fixed point and carrying a roller cooperating with a grooved cam and a link articulated to said lever.

FIGS. 5 through 7 show a mechanical drive device of this kind for the mobile back 16. The figures show a disk 27 which is coupled to the single drive motor (not shown) and in which are formed guide grooves 30 for a roller 28 carried by a lever 29 which rotates about a fixed horizontal axis 31 and is articulated at its end to a link 32.

The complete movement of the back 16 is divided into two successive rotations and there are therefore two drive devices for the back 16 each comprising a grooved disk, a lever and a link; the two mechanisms remain coincident during the first rotation as can be seen in FIGS. 5 and 6 where the two levers 29 and 29' and the two lines 32 and 32' are shown with different thickness, so that they can be distinguished from each other. The two guide grooves are naturally also similarly disposed for this first rotation. The end of the first link 32 is articulated to an L-shaped member 33 which is articulated about a fixed horizontal axis 40 constituting the rotation axis of the first rotation; this L-shaped member 33 is also articulated to a lug 34 joined to the rear surface 35 of the back 16. Also articulated to the lug 34 is a set of two links 36 and 37 articulated to each other, the free end of the link 37 being also articulated about the fixed horizontal rotation axis 34.

As mentioned above, during the first rotation the grooves 30 and 30' follow identical paths and as a result the levers 29 and 29' remain aligned with each other as do the links 32 and 32'; the result of this is that the combination of the L-shaped member 33 and the two links 36 and 37 is not deformed. The two grooves 30 and 30' move regularly towards the disk 27, the links 32 and 32', through the intermediary of the L-shaped member 33 and the links 36 and 37, rotating the back 16 about the fixed horizontal axis 40 which is substantially in the median horizontal plane of the back 16 and at a distance from it substantially equal to half its height. At the end of this first rotation the back 16 is in the position shown in FIG. 6, that is to say substantially horizontal after having rotated a quarter-turn about the axis 40, the rear surface 35 of the back 16 facing downwards so that the opposite, operative side faces upwards. The lower edge 10 of the back 16 is on the right in the figure, that is to say near the wall 5 separating the user area from the cleaning area 4.

This first rotation corresponds to what was explained with reference to FIG. 4; the second rotation occurs about the axis 38 articulating the L-shaped member 33 to the lug 34. The guide groove 30 of the lever 29/link 32 system is designed so that this system remains fixed in place; on the other hand, the groove 30' for the roller 28' guiding the lever 29' is shaped so that the mobile end of the lever 29' rises, so as to drive the link 32' upwards, which entrains the two links 36 and 37 upwards; the link 37 is then no longer coincident with the end of the L-shaped member 33 and these various movements cause the mobile back 16 to rotate from its intermediate position 16'' to its cleaning position 16''', rotating about the axis 38 which remains fixed in place throughout this second movement. Note that after these two rotations the front surface of the back 16 is facing the cleaning device 18.

Obviously, the rotation of the pan 6 is also commanded by a grooved disk operating a lever and a link disposed in a similar way to the lever 29 and link 32.

Figure 10:
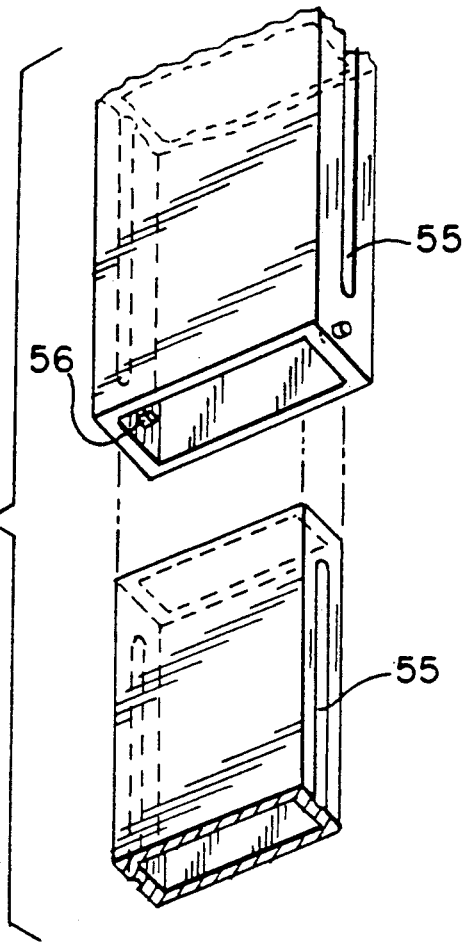

FIGS. 8 through 10 show the drying device which is slidably mounted in the area 26 (see FIG. 3). The drying device is essentially constituted by a vertically disposed flat nozzle 41; it is supplied by an electrically driven compressor (not shown) disposed in the upper part of the cleaning area 4; the air supplied by this compressor is directed laterally by a lateral blowing outlet 42, as can be seen particularly clearly in FIG. 9 which is transverse cross-section through the nozzle 41.

The blower nozzle 41 is mounted to slide on vertical guides 45 and driven by chains 46 fixed to the nozzle 41 at 47 and cooperating with sprocket wheels 48 fixed to a shaft 49 coupled to a drive motor (not shown).

The blower nozzle blow dries the back 16 and the pan 6 when it moves down into the area 26.

The vertical translation movement of the blower nozzle 41 covers a long distance (75 cm in one embodiment of the invention) and it is therefore necessary to provide a variable length feed pipe between the compressor and the nozzle. In one embodiment of the invention this is achieved by means of four telescopic tubes which successively fit one within the other with a small clearance in the order of 0.1 mm to minimize losses, the widest tube being that at the bottom. As shown in FIGS. 10 and 10*a*, to achieve good guidance of the tubes relative to each other each tube has on its exterior surface two opposed grooves 55 cooperating with pins 56 projecting from the interior surface of each tube. The various tubes advantageously have a rectangular cross-section, averaging 15×75 mm, for example. The tubes may be manufactured by molding, given that the grooves 65 are open on one side.

As mentioned above, all displacements of the moving parts are commanded by a motor-gearbox unit, each movement from the use position to the cleaning position or vice-versa corresponding to one half-turn of the motor-gearbox unit. As a result the complete cycle of cleaning and returning to the use position is completed over one turn of the motor which turns always in the same direction.

The pan 6 may advantageously be of the type described in French patent application No 86 05 524 of 17 Apr. 1986 "Module sanitaire a nettoyage automatique" ("Self-cleaning sanitation module") in which the top opening of the pan is divided into two sections by a partition substantially parallel to the wall separating the use and cleaning areas; this partition extends towards the bottom of the pan, stopping short of it, its upper surface forming the posterior part of the toilet seat. This provides a use section and an evacuation section the opening in which communicates with a drain when the pan is in the cleaning position. This arrangement means that the toilet seat can have a somewhat more conventional appearance to avoid putting off users. A pan of this kind is shown in FIG. 11.

In accordance with the invention, to improve further the conventional appearance of the pan a device is provided for supplying the pan with water; this device is actuated when the pan returns to the use position. In this way, when the user enters the module he sees a toilet pan of entirely conventional appearance.

Figure 11:
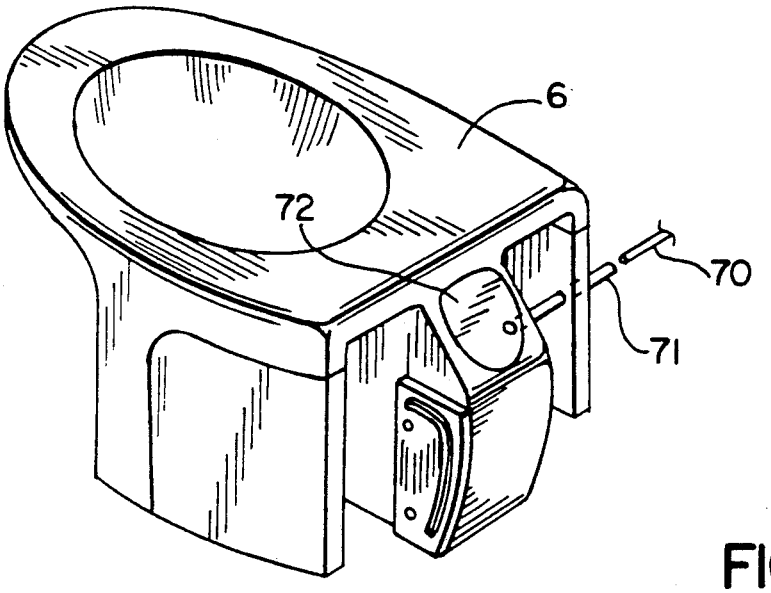
FIG. 11 shows one embodiment of the toilet pan with its water supply device.

A water supply device of this kind is shown in FIG. 11. It comprises a fixed pipe 70 into which is placed a pipe 71 carried by the pan 6 and opening into the evacuation section 72 of the pan. The two pipes 70 and 71 are disposed so that when the pan 6 is in the use position they are aligned with each other and their length is such that they are at a very small distance from each other. The pipe 70 advantageously has an internal cross-section that is smaller than that of the pipe 71, to avoid any loss of water on supplying the pan 6.

A heating element may further be provided in the upper part of the pan, of which the toilet seat forms an integral part. This heating element is advantageously provided with a temperature regulating thermostat.

Figure 12:
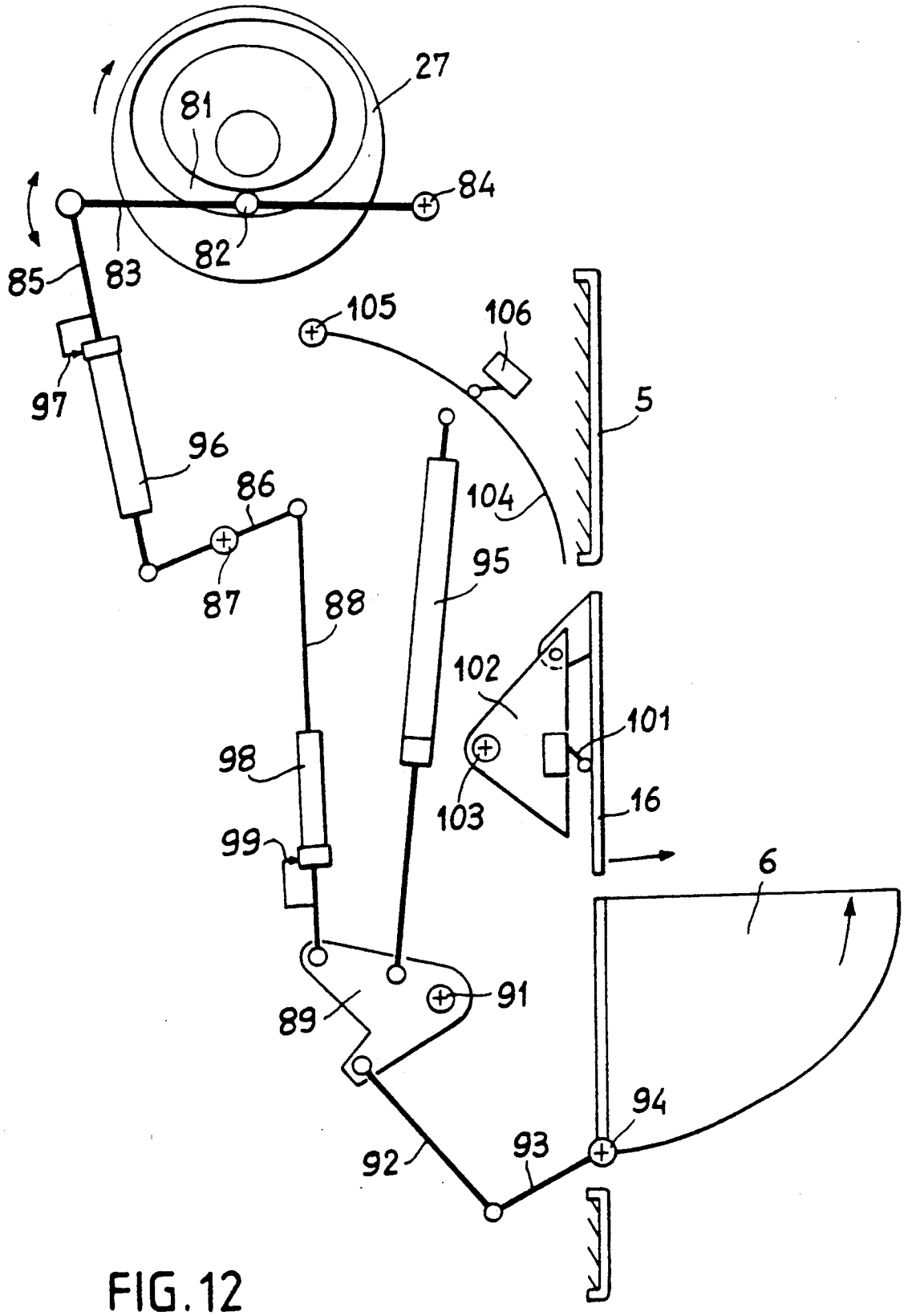
FIG. 12 is a diagram showing the security device.

FIG. 12 is a schematic representation of the device which moves the toilet pan 6. This mechanical device is commanded by the same disk 27 as the back displacement device; this disk comprises a guide groove 81 in which rolls a roller 82 carried by a lever 83 mounted to rotate about a fixed horizontal axis 84 and articulated at its end to a link 85. The link 85 operates on a lever 86 articulated about a central horizontal axis 87 and which operates on a second link 88 which operates on a pivotting member 89 articulated about a fixed horizontal axis 91 which operates on two links 92 and 93, the latter link 93 being fixed to the pan 6 which pivots about a fixed horizontal axis 94.

This kinematic system is balanced by means of a compensating device 95 so that the forces required to tilt the pan backwards and forwards are low.

In accordance with the invention there is provided a first security device protecting against jamming of the tilting movement, due for example to the insertion of part of the body of the user between the pan and the back 16 or by the presence of a light object in the pan; in one embodiment this security device is operative when the force for the up or down tilting movement is greater than 2 to 3 kg. The security device is operative in both tilting directions and immediately stops the tilting of the back and the pan. The invention provides a retrograde movement over an angle of approximately two to three degrees for clearing the jam, in particular when a person has got his fingers stuck in the mechanism. This retrograde movement is followed by a second attempt at the movement which was interrupted and if there is still a jam the movement is definitively stopped and an alarm is sent to a centralized surveillance device.

In the FIG. 12 embodiment this security device is constituted for each direction of tilting by a piston-and-cylinder damper incorporated into a link in such a way that it operates in compression, this compression closing a microswitch in a security electrical circuit. For the movement towards the cleaning position a damper 96 of this kind is incorporated into the link 85, the damper 96 being associated with a microswitch 97; for the return movement to the use position the security device is constituted by a damper 98 incorporated into the link 88 and associated with a microswitch 99.

In accordance with the invention, an additional security device is implemented to protect against the presence of a large object in the pan, this object becoming jammed between the pan and the back during the tilting movement towards the cleaning position, for example. In the example shown in FIG. 12 this security device is constituted by a microswitch 101 which is disposed between the back 16 and the beam 102 mobile about the axis 103 which drives the back 16.

Finally, a third security device is provided to guard against the situation where a hand, for example, is inserted between the top of the back 16 and the separating wall 5. To this end there is provided a kind of vault 104 mounted to rotate about a horizontal axis 105 and the end of which comes almost into contact with the top of the back 16 when the latter is in the use position. A microswitch 106 associated with the vault 104 senses any movement thereof due to anything jammed between the wall 5 and the back 16.

In any event, in the practical implementation of this sanitation module the clearances between all mobile parts and fixed parts is less than 5 mm.

Finally, there is provided in the known way a weight sensor with two operating thresholds (4 kg and 25 kg, for example) coupled to a floor section around the pan 6; a final security device senses the presence of a person seated on the pan (from 2 kg) to inhibit initiation of the process of tilting to the cleaning position.

It is seen that the invention makes it possible to produce a sanitation module with particularly compact overall dimensions and which has a conventional appearance and specifically a back for the user. Moreover, this sanitation module offers very high security, in particular with regard to the possibility of inserting objects or part of the body into the cleaning area.

There is claimed:

1. Self-cleaning sanitation module comprising a closed enclosure, a vertical wall in said enclosure dividing it into a user area and a technical area, an opening in said wall, an open-top toilet pan having a top surface lying in a first plane and disposed along said vertical wall and adapted to rotate about an axis parallel to said vertical wall between a use position in which said top surface is rotated through said opening and into said user area such that said top surface lies in a plane substantially normal with respect to said vertical wall and a cleaning position in which said top surface is rotated through said opening and into said technical area such that said top surface is substantially vertical and faces toward said technical area, a back plate having upper, lower and side edges and being movably mounted in said enclosure between a use position in which it covers said opening above said toilet pan when said pan is in its use position and a cleaning position in which it is vertically above said pan and coplanar with said top surface of said pan when said pan is in said cleaning position, and cleaning means in said enclosure for cleaning said pan and said back plate when in their cleaning position, said back plate being adapted to rotate about horizontal axes parallel to said vertical wall on moving from its use position to its cleaning position, said back plate being articulated so that it performs a first rotation from its use position about a first horizontal axis located at the rear of said back plate when in its use position, said first horizontal axis being in a substantially median plane of said back plane and at a distance from the latter substantially equal to half the height of said back plate so that said lower edge of said back plate remains near said top surface of said pan during rotation of said pan from its use position toward its cleaning position, said back plate then proceeding to an intermediate position in which said back plate is substantially horizontal with respect to said vertical wall, and said back plate performing a second rotation about a second horizontal axis near its upper edge from said intermediate position to its cleaning position.

2. Module according to claim 1 wherein said pan is adapted to rotate about a horizontal axis located at a lower part thereof near said wall so that in its cleaning position it lies behind said wall.

3. Module according to claim 1 further comprising in said technical area a compressed air supply connected to a flat nozzle and means adapted to move said nozzle vertically in translation and produce a moving air curtain.

4. Module according to claim 1 further comprising a single motor-gearbox unit, a grooved cam disk rotatably mounted on said unit, a lever articulated about a fixed axis on said module, a roller on said lever cooperating with said cam disk and linkage means driven by said lever and pivotally connected to said back plate for moving the same, said motor-gearbox unit running in the same direction for moving said back plate from its use position to its cleaning position and back again.

5. Module according to claim 1 wherein said pan comprises a partition substantially parallel to said wall when said pan is in its use position and dividing its open top into two sections and extending towards but not as far as its bottom, an upper surface of said partition forming a posterior part of said pan, one of said two sections being an evacuation section adapted when said pan is in its cleaning position to communicate with a drain, the module further comprising a device for feeding water into said pan adapted to be actuated as said pan returns to its use position.

6. Module according to claim 4 further comprising a telescopic air duct connecting said compressed air supply to said flat nozzle.

7. Module according to claim 1 further comprising counterbalance means for displacement of said pan and security devices adapted to stop tilting movement of said pan in response to an undue resisting force in the movement of said pan.

8. Module according to claim 7 wherein said security devices are adapted to respond to stopping of said tilting movement by applying a small amplitude retrograde movement followed by recommencement of the stopped movement.

9. Module according to claim 7 further comprising a sensor that senses whether the resisting force on said pan is above a predetermined level, said sensor including a mobile member movably mounted in said module and having a free end responsive to said resistive force, said sensor being disposed in said module near the top of said pan when said pan is in its use position.

* * * * *